US007789082B2

(12) United States Patent
Woon

(10) Patent No.: US 7,789,082 B2
(45) Date of Patent: Sep. 7, 2010

(54) RACK STRUCTURE OF OVEN

(75) Inventor: Cho Hae Woon, Busan-si (KR)

(73) Assignee: LG Electronics Inc., Seoul (KR)

( * ) Notice: Subject to any disclaimer, the term of this patent is extended or adjusted under 35 U.S.C. 154(b) by 1429 days.

(21) Appl. No.: 11/199,157

(22) Filed: Aug. 9, 2005

(65) Prior Publication Data

US 2006/0027105 A1 Feb. 9, 2006

(30) Foreign Application Priority Data

Aug. 9, 2004 (KR) ..... 10-2004-0062360
Aug. 9, 2004 (KR) ..... 10-2004-0062361

(51) Int. Cl.
*F24C 15/16* (2006.01)
*A47B 96/02* (2006.01)

(52) U.S. Cl. ..... 126/339; 126/337 R; 126/337 A; 211/153; 211/175

(58) Field of Classification Search ..... 126/9 B, 126/337 R, 339, 25 R, 9 R, 337 A; 211/153, 211/175; D15/89; D7/402, 409; 160/219; 312/246; 99/449; 108/148
See application file for complete search history.

(56) References Cited

U.S. PATENT DOCUMENTS 1,350,330 A * 8/1920 Partonnar ..... 126/338
1,930,773 A * 10/1933 Saum ..... 211/153
1,997,432 A * 4/1935 Replogle ..... 211/153
2,057,429 A * 10/1936 Heim ..... 211/153
2,166,707 A * 7/1939 Schweller ..... 211/153
2,169,763 A * 8/1939 Kucher ..... 211/153
2,205,781 A * 6/1940 Vining ..... 62/288
2,223,947 A * 12/1940 Blood et al. ..... 62/288
2,262,578 A * 11/1941 Ellis ..... 211/153
2,294,155 A * 8/1942 Boddy ..... 211/153
2,466,360 A * 4/1949 Bitney ..... 108/137
2,842,269 A * 7/1958 Gomersall ..... 211/41.2
2,928,552 A * 3/1960 Gomersall ..... 211/85.4
3,245,572 A * 4/1966 Mashy et al. ..... 312/109
3,450,025 A * 6/1969 Fleming ..... 99/399
3,800,985 A * 4/1974 Grout et al. ..... 222/146.2
3,848,748 A * 11/1974 Ceccarelli ..... 211/195
4,023,682 A * 5/1977 Niece ..... 211/184
4,231,175 A * 11/1980 Baxter ..... 40/374
4,553,523 A * 11/1985 Stohrer, Jr. ..... 126/9 B
4,559,869 A * 12/1985 Hogan ..... 99/426
4,901,867 A * 2/1990 Petty, Jr. ..... 211/46
5,299,931 A * 4/1994 Lee ..... 431/25
6,349,717 B1 * 2/2002 Thompson et al. ..... 126/337 R
6,564,950 B1 * 5/2003 Holm ..... 211/85.31

FOREIGN PATENT DOCUMENTS

JP 11-276362 * 10/1999

* cited by examiner

*Primary Examiner*—Carl D Price
(74) *Attorney, Agent, or Firm*—Birch, Stewart, Kolasch & Birch, LLP

(57) ABSTRACT

A rack structure of an oven is provided. In the rack structure, a fixed shelf is disposed in a cavity of an oven and it includes an opening with a predetermined size and a vertical bar arranged on each side of the opening, a slide bar includes an end slidable along the vertical bar, and a movable shelf includes at least one portion supported by the slide bar and it is capable of opening and closing the opening.

15 Claims, 10 Drawing Sheets

RACK STRUCTURE OF OVEN

BACKGROUND OF THE INVENTION

1. Field of the Invention

The present invention relates to a rack installed in an oven, and more particularly, to a rack structure of an oven for receiving food or a food container such as a pan.

2. Description of the Related Art

Electronic ovens are used for cooking food. Generally, a container filled with food is placed on a rack installed in a cavity of an electric oven, and then the food is heated by an electric heater for cooking. An electric oven includes an electric heater and a convection fan to heat food through radiation or convection, such that the food can be cooked as if it is cooked on a grill or in a convection oven. In addition, the electric oven may include a magnetron to radiate electromagnetic waves to heat food more quickly. Usually, the electric oven further includes a door on a front side and a hinge structure on a lower portion of the door to allow opening and closing motion of the door in up and down directions. That is, a user can load and unload food into and from the electric oven through the door.

The electric oven further includes a rack installed in a cavity in a horizontal direction to receive food when the food is loaded in the cavity. The food can be directly placed on the rack or it can be placed on a tray before placed on the rack. However, the rack is not easily removed form the cavity after it is once installed. Also, a food container or food having a relatively large volume cannot be loaded in the cavity since the cavity is divided into up and down portions by the rack. That is, a food container or food having a smaller size than the cavity may not be inserted into the cavity because of the rack.

Therefore, there is an increasing need for an improved rack structure for effectively using the limited space of the cavity. Also, there is an increasing need for an improved rack structure for stably loading food on the rack, in addition to the effective using of the limited space of the cavity.

SUMMARY OF THE INVENTION

Accordingly, the present invention is directed to a rack structure of an oven that substantially obviates one or more problems due to limitations and disadvantages of the related art.

An object of the present invention is to provide a rack structure of an oven for an effective use of a cavity of the oven.

Another object of the present invention is to provide a rack structure of an oven, in which a rack can be easily changed depending on the type of food to be cooked.

A further another object of the present invention is to provide a rack structure of an oven that can stably support food.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a rack structure of an oven defining a cavity therein to cook food, the rack structure including: a fixed shelf disposed in the cavity and including an opening with a predetermined size and a vertical bar arranged on each side of the opening; a slide bar including an end slidable along the vertical bar; and a movable shelf including at least one portion supported by the slide bar and being capable of opening and closing the opening.

In another aspect of the present invention, there is provided a rack structure of an oven defining a cavity therein to cook food, the rack structure including: a fixed shelf disposed in the cavity; an opening defined in the fixed shelf with a predetermine size; and a movable shelf capable of opening and closing the opening.

In a further another aspect of the present invention, there is provided a rack structure of an oven defining a cavity therein to cook food, the rack structure including: a fixed shelf disposed in the cavity; a movable shelf detachably installed on the fixed shelf; and a slide bar slidable along a portion of the fixed shelf for supporting the movable shelf.

The rack structure increases user's convenience and provides more effective way of using the cavity of the oven.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
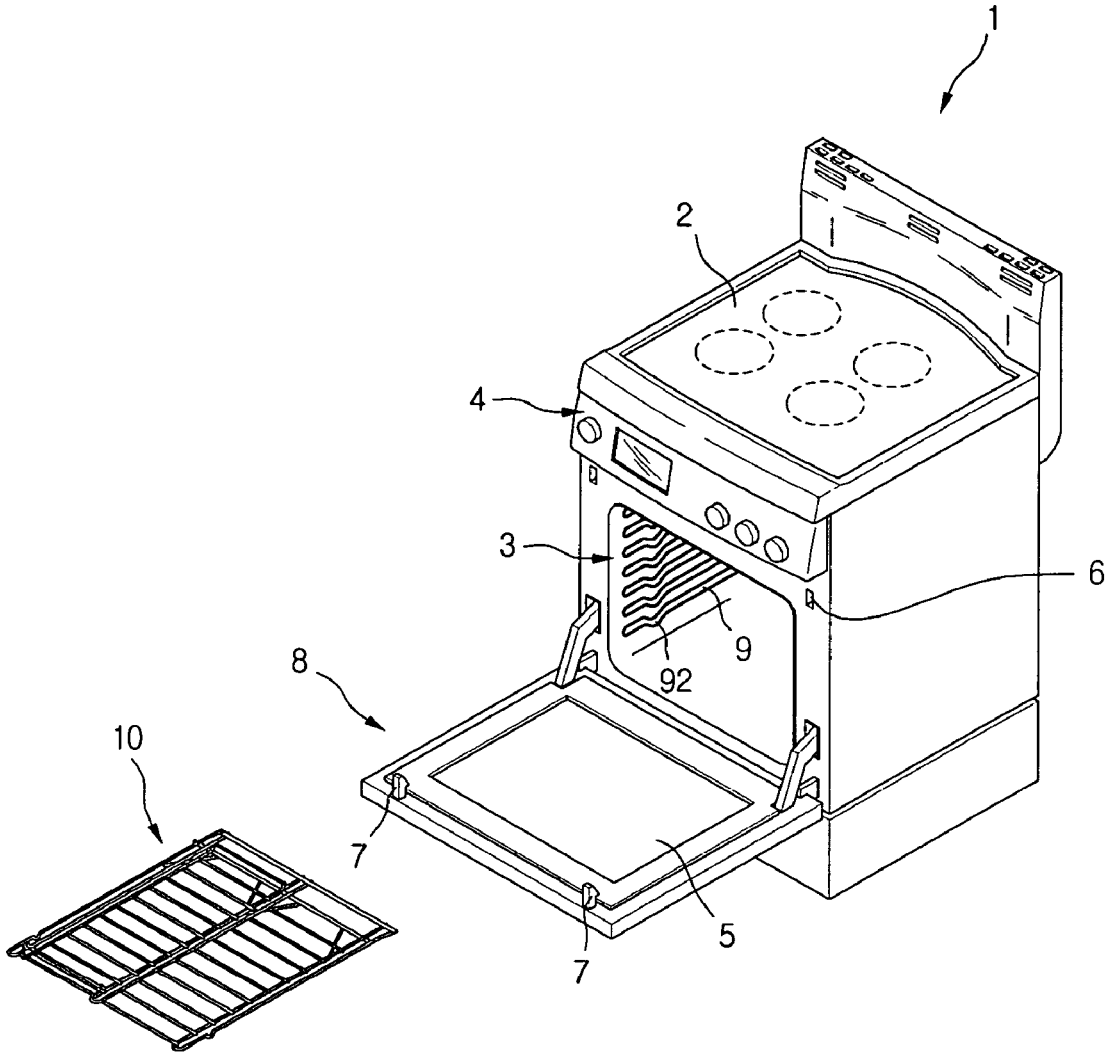
FIG. 1 is a perspective view of an oven employing a rack structure according to a first embodiment of the present invention.

FIG. 1 is a perspective view of an oven employing a rack structure according to a first embodiment of the present invention.

Referring to FIG. 1, an oven 1 includes a cook top 2 at a top to heat food contained in a food container such as a pan, a cavity 3 defined under the cook top 2 to receive food for cooking, and a control panel 4 formed on an upper front side and having various buttons and a display. The oven 1 further includes a door 8 hinged on a front side for selectively open and close the cavity 3. The oven 1 further includes a rack 10 to be installed in the cavity 3 for receiving food or a food container thereon. The oven 1 further includes locking tabs 7 on an upper end and tab insertion holes 6 for coupling with the locking tabs 7. The door 8 includes a transparent window 5 such that the cavity 3 can be viewed from the outside when the door 8 is closed. The oven 1 further includes a plurality of grooves 9 in both inner side walls to receive and support the rack 10 in a horizontal direction.

In operation, when a food container filled with food is placed on the cook top 2 and the control panel 4 is manipulated, heat is generated from the cook top 2 to cook the food. Also, the rack 10 is horizontally inserted in the cavity 3 with its both sides being supported by the grooves 9, and food or a food container filled with food is placed on the rack 10. The food in the cavity can be cooked by manipulating the control panel 4.

The door 8 is hinged on the front of the oven 1 for rotation. When the door 8 is rotated up, the locking tabs 7 are inserted in the tab insertion holes 6 to securely couple the door 8 to a main body of the oven 1. In this way, the cavity 3 can be closed from the outside.

Figure 2:
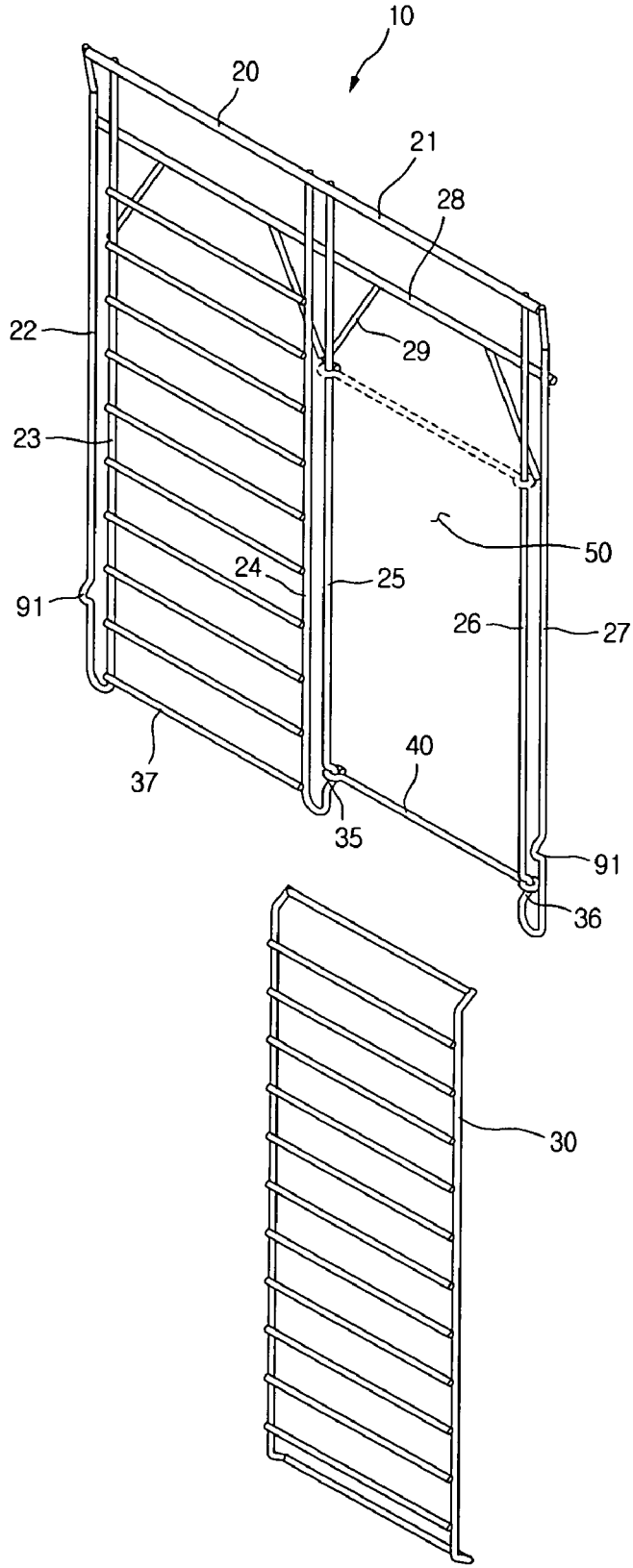
FIG. 2 is an exploded perspective view of the rack structure depicted in FIG. 1.

FIG. 2 is an exploded perspective view of the rack structure depicted in FIG. 1;

Referring to FIG. 2, the rack 10 includes a fixed shelf 20 to be inserted in the grooves 9 and a movable shelf 30 that can be freely detachable from the fixed shelf 20.

The fixed shelf 20 includes a plurality of bars arranged in horizontal, vertical, and inclined directions. In detail, the fixed shelf 20 includes a first horizontal bar 21 at an rear end, first to sixth vertical bars 22, 23, 24, 25, 26, and 27 that are arranged in a perpendicular direction to the horizontal bar 21, and a second horizontal bar 28 located a predetermined distance from the first horizontal bar 21 for reinforcement. The first to sixth vertical bars 22, 23, 24, 25, 26, and 27 are substantially perpendicular to the first and the second horizontal bars 21 and 28. Also, the fixed shelf 20 includes a plurality of support bars 29 that are arranged at an angle to the second horizontal bar 28 and the first to sixth vertical bars 22, 23, 24, 25, 26, and 27 to increase strength of the fixed shelf 20.

The rack 10 further includes a slide bar 40 between the fourth vertical bar 25 and the fifth vertical bar 26. The slide bar 40 can be freely slid back and forth in front and back directions between the fourth and fifth vertical bars 25 and 26.

The vertical bars 25 and 26 respectively include receiving grooves 35 and 36 that are defined in a top-to-bottom direction to receive the slide bar 40. Each of the receiving grooves 35 and 36 is sloped down toward a center with a predetermined curvature. While moving the slide bar 40 along the vertical bars 25 and 26, the slide bar 40 can be caught in the grooves 35 and 36. Therefore, the slide bar 40 can be stopped with respect to the vertical bars 25 and 26. The slide bar 40 can be released from the receiving grooves 35 and 36 and moved again along the vertical bars 25 and 26 when it is slightly pushed up. Backward movement of the slide bar 40 is limited by the support bars 29. That is, the slide bar 40 as it moves in a backward direction contacts the support bars 29. The backward limit position of the slide bar 40 is shown by an imaginary line in FIG. 2.

The first and sixth vertical bars 22 and 27 respectively include curved portions 91 at predetermined locations. The curved portions 91 is coupled with curved portions 92 of the grooves 9 when the fixed shelf 20 is fully inserted into the groove 9, such that the fixed shelf 20 can be securely fixed in the fully inserted position. By applying force to the fixed shelf 20, the fixed shelf 20 can be released and removed.

The plurality of bars of the fixed shelf 20 are arranged in a top-to-bottom direction as follows: the first horizontal bar 21 is placed at the highest locations; the vertical bars 22, 23, 24, 25, 26, and 27 are placed under the first horizontal bar 21; and the support bars 29 and the second horizontal bar 28 are placed at the same height under the vertical bars 22, 23, 24, 25, 26, and 27. In addition, the fixed shelf 20 includes a plurality of receiving bars 37 above the vertical bars 22, 23, 24, 25, 26, and 27 to receive food, a food container, a tray, or the like.

The rack 10 is divided into the fixed shelf 20 and the movable shelf 30, such that the movable shelf 30 can be removed from the cavity 3 for partial use of the rack 10. When the movable shelf 30 is removed and the slide bar 40 is moved to the back, the rack defines an opening 50 between the fourth and fifth vertical bars 25 and 26. Through the opening 50, food having a relatively long shape can be placed in the cavity 3, thereby increasing spatial efficiency and user's convenience. For example, food such as a chicken can be put in the cavity 3 after removing the movable shelf 30 to allow the chicken to rise through the opening. Therefore, food can be cooked more easily.

Figure 3:
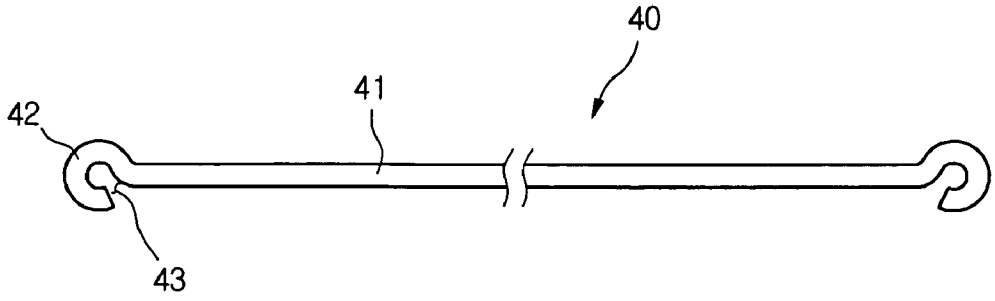
FIG. 3 is a front view of a slide bar of the rack structure depicted in FIG. 2.

FIG. 3 is a front view of a slide bar of the rack structure depicted in FIG. 2.

Referring to FIG. 3, the slide bar 40 includes a bar portion 41, curved portions 42 having a circular shape, and insertion gaps 43 defined between tips of the curved portions 42 and the bar portion 41. The vertical bars 25 and 26 are respectively inserted through the insertion gaps 43 into the curved portions 42. Owing to this coupling between the curved portions 42 and the vertical bars 25 and 26, movement of the slide bar 40 can be securely guided.

Between the fourth vertical bar 25 and the fifth vertical bar 26, the movable shelf 30 is seated in a predetermined way without using additional fasteners such as screws. A structure of the movable shelf 30 will now be described more fully.

Figure 4:
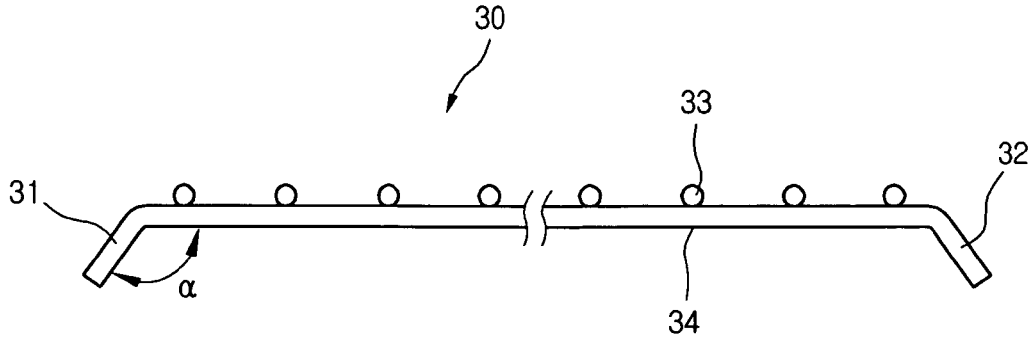
FIG. 4 is a side view of a movable shelf of the rack structure depicted in FIG. 2.

FIG. 4 is a side view of a movable shelf of the rack structure depicted in FIG. 2. The movable shelf 30 is symmetric such that the left and right side views of the movable shelf 30 are identical.

Referring to FIG. 4, the movable shelf 30 includes a rectangular frame 34, front and rear guides 31 and 32 formed on front and rear ends of the frame 34 and bent downward, and a plurality of receiving bars 33 fixed to a top of the frame 34.

When the front and rear guides 31 and 32 are respectively abutted on the slide bar 40 and the second horizontal bar 28, the position of the movable shelf 30 is fixed. For stable positioning of the movable shelf 30, the slide bar 40 may be seated in the receiving grooves 35 and 36. Also, lateral positioning of the movable shelf 30 may be guided by the fourth and fifth vertical bars 25 and 26 of the fixed shelf 20.

In detail, the second horizontal bar 28 is placed lower than the fourth and fifth vertical bars 25 and 26, and the bar portion 41 of the slide bar 40 is lower than the curved portions 42 of the slide bar 40, such that the movable shelf 30 can be placed at the same height as the fourth and fifth vertical bars 25 and 26. Also, the movable shelf 30 has the same width with the distance between the fourth vertical bar 25 and the fifth vertical bar 26. Therefore, both sides of movable shelf 30 can be abutted against the fourth and fifth vertical bars 25 and 26 for stable and secure positioning of the movable shelf 30.

Further, the support bars 29 supports the bottom of the movable shelf 20 when the movable shelf 30 is placed on the fixed shelf 20, such that the movable shelf 30 can be supported more securely.

Figure 5:
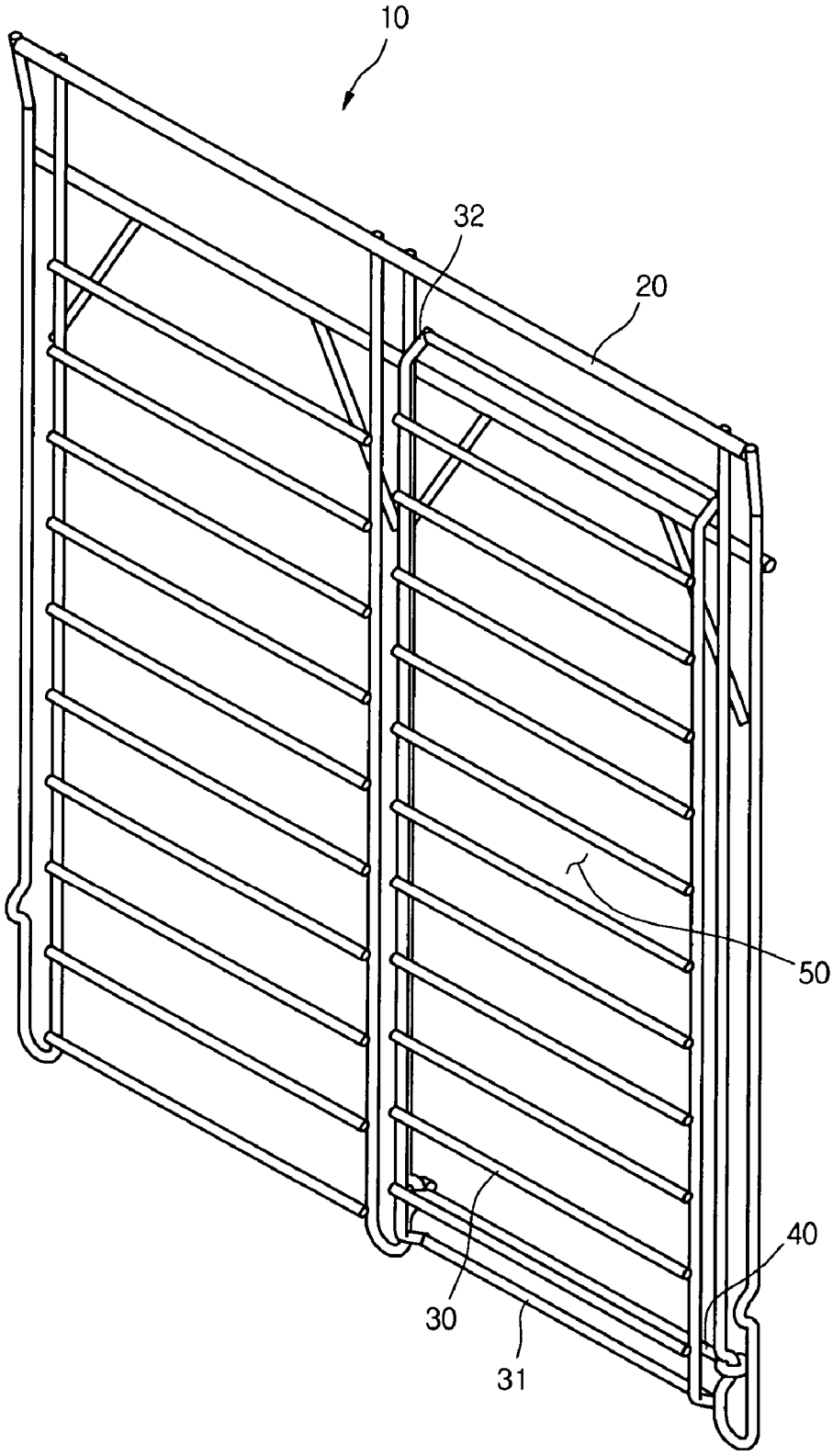
FIG. 5 is a perspective view showing the movable shelf depicted in FIG. 4 when it is coupled with a fixed shelf according to the first embodiment of the present invention.
Figure 6:
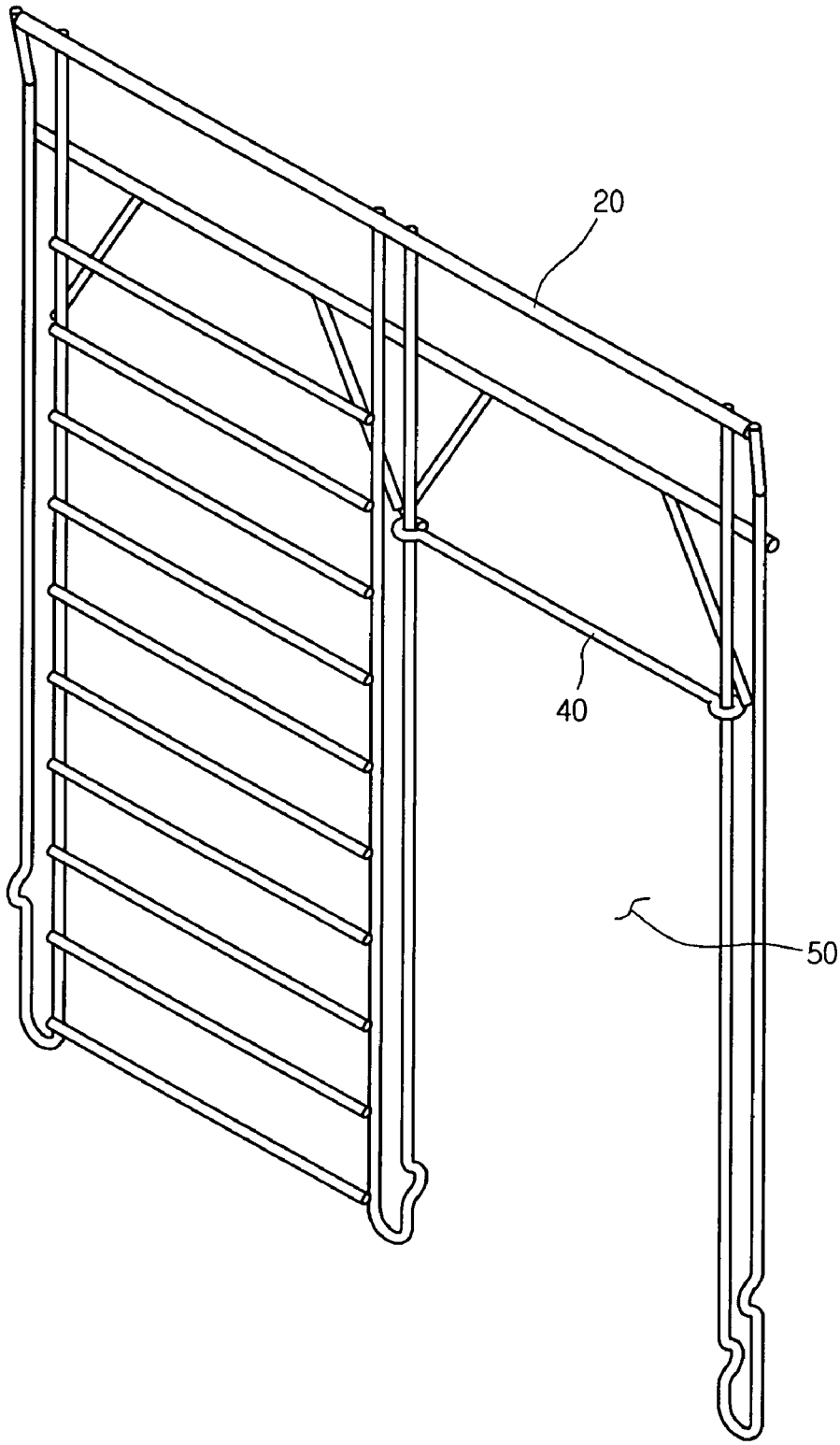
FIG. 6 is a perspective view showing the fixed shelf depicted in FIG. 5 when the movable shelf is removed from the fixed shelf.

FIG. 5 is a perspective view showing the movable shelf depicted in FIG. 4 when it is coupled with a fixed shelf according to the first embodiment of the present invention, and FIG. 6 is a perspective view showing the fixed shelf depicted in FIG. 5 when the movable shelf is removed from the fixed shelf.

Referring to FIGS. 5 and 6, when the movable shelf 30 is seated on the fixed shelf 20, the opening 50 is closed by the movable shelf 30. In this state, food or a food container can be placed on the movable shelf 30 for cooking. The front guide 31 is supported by the slide bar 40, and the rear guide 32 is supported by the second horizontal bar 28, such that the entire bottom of the movable shelf 30 can be stably supported without shaking.

Specifically, when the movable shelf 30 is seated on the fixed shelf 20, the rear guide 32 can be easily guided to a proper position by aligning the front guide 31 with the slide bar 40. Therefore, the seating of the movable shelf 30 on the fixed shelf 20 can be easily carried out.

Also, after the movable shelf 30 is removed from the fixed shelf 20, the opening 50 can be completely opened by pushing the slide bar 40 to a back position. Therefore, food can be placed in the cavity 3 through the opening 50 without disturbance by the rack 10.

With this structure, the cavity 3 can be used more efficiently. That is, various kind of food can be placed in the cavity 3 by removing the movable shelf 30 from the rack 10 instead of entirely removing the rack 10 from the cavity 3.

Second Embodiment

The second embodiment is similar to the first embodiment. Thus, the same descriptions as those for the first embodiment will be omitted for conciseness.

Figure 7:
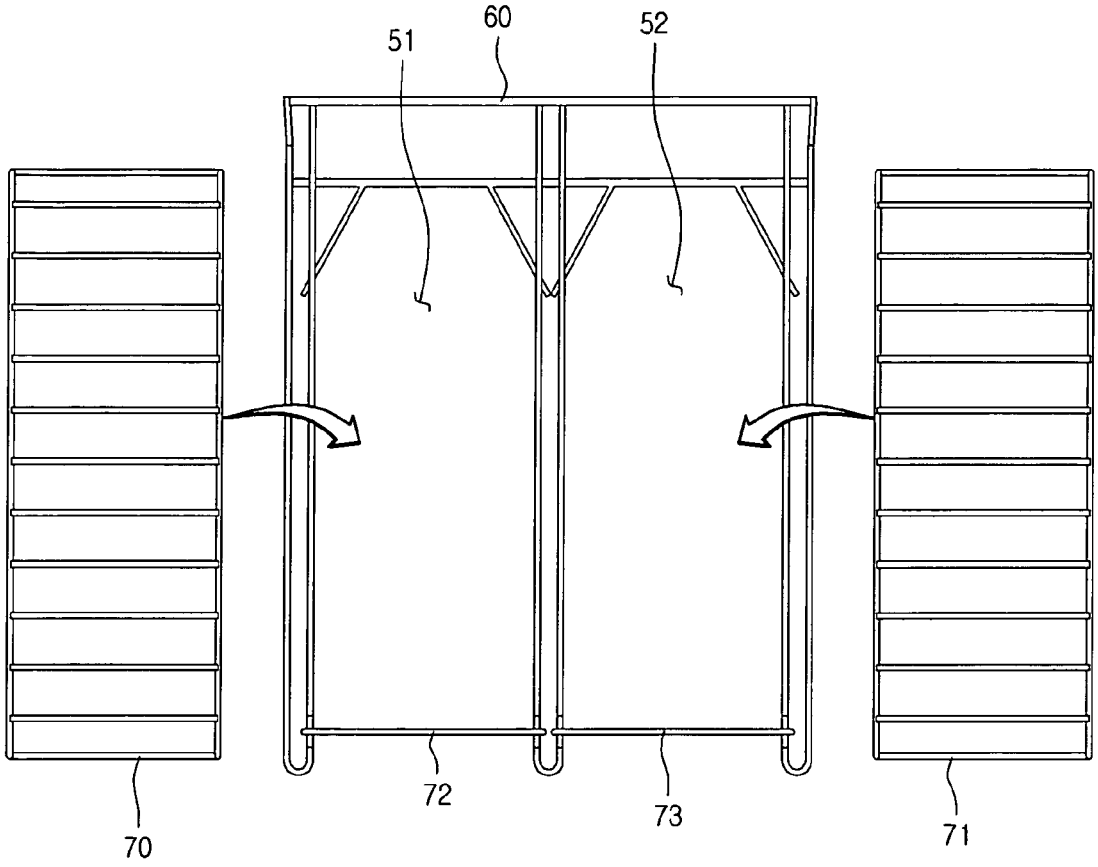
FIG. 7 is an exploded plan view of a rack structure according to a second embodiment of the present invention.

FIG. 7 is an exploded plan view of a rack structure according to a second embodiment of the present invention.

Referring to FIG. 7, first and second movable shelves 70 and 71 are placed on left and right sides of a fixed shelf 60. Also, first and second slide bars 72 and 73 are respectively installed at left and right sides to support front ends of the first and second movable shelves 70 and 71.

With this structure, various kind of food having a relatively large size can be placed in the cavity 3 by removing the first and second movable shelves 70 and 71 from the cavity 3 instead of entirely removing the rack from the cavity 3. Therefore, food can be placed in the cavity 3 more effectively. That is, food can be placed in the cavity 3 through first and second openings 51 and 52, such that food having a relatively large size can be cooked in the cavity 3.

Third Embodiment

Figure 8:
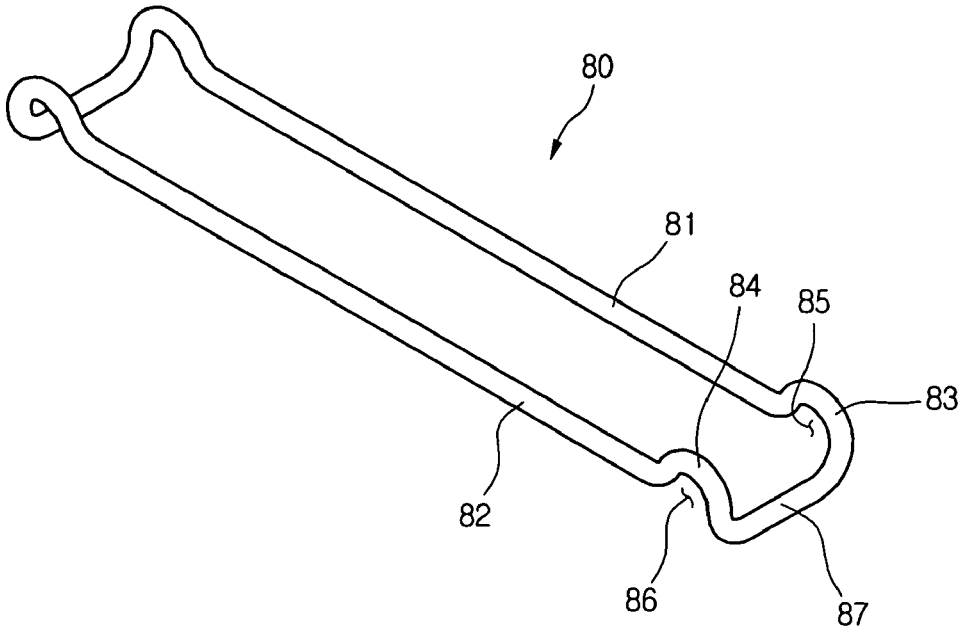
FIG. 8 is a perspective view of a multiple slide bar according to a third embodiment of the present invention.

FIG. 8 is a perspective view of a multiple slide bar according to a third embodiment of the present invention.

Referring to FIG. 8, the third embodiment of the present invention is characterized in that a multiple slide bar 80 includes a plurality of bar portions. In detail, the multiple slide bar 80 includes two bar portions 81 and 82 in a horizontal direction, curved portions 83 and 84 formed on ends of the bar portions 81 and 82, and insertion gaps 85 and 86 defined in the curved portions 83 and 84 for coupling with vertical bars. Though it is shown that the number of the bar portions 81 and 82, curved portions 83 and 84, and insertion gaps 85 and 86 are respectively two, they can be three or more in number without departing from the scope of the present invention.

The curved portions 83 and 84 are connected through connecting portions 87, such that the multiple slide bar 80 can be formed in one piece. That is, the multiple slide bar 80 forms a single loop. This structure increases the strength of the multiple slide bar 80, such that heavier food can be placed on the rack. Also, the insertion gaps 85 and 86 are widely opened such that the vertical bars can be easily inserted and removed into and from the insertion gaps 85 and 86. That is, the multiple slide bar 80 can be easily moved along the vertical bars because of reduced contact area and it can be easily installed and removed.

The bar portions 81 and 82 may be parallel with each other to provide stable support.

Figure 9:
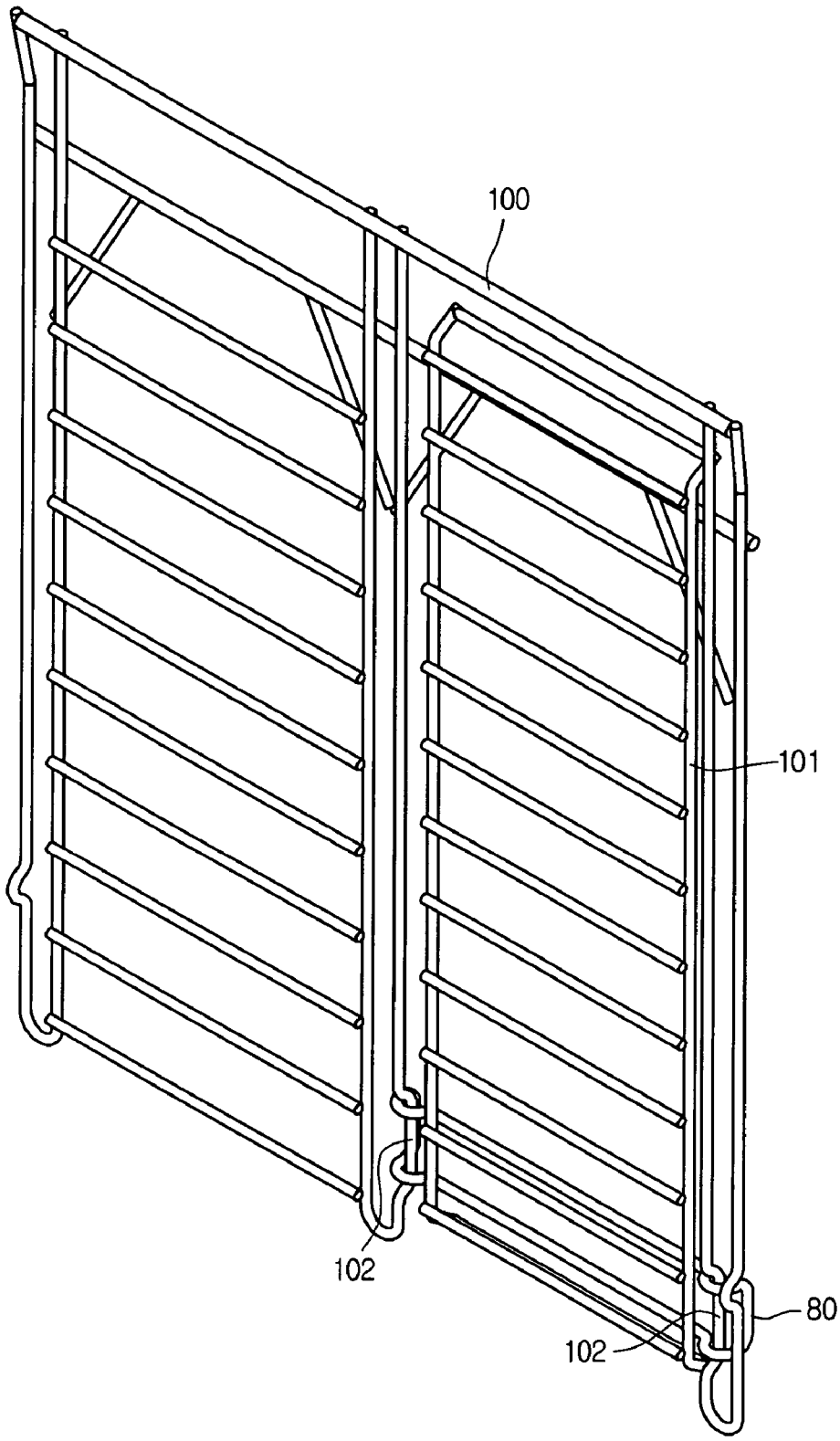
FIG. 9 is a perspective view of a rack structure according to the third embodiment of the present invention.

FIG. 9 is a perspective view of a rack structure according to the third embodiment of the present invention; and Referring to FIG. 9, a movable shelf 101 is seated on a fixed shelf 100, and the multiple slide bar 80 is placed to support a front side of the movable shelf 101. Specifically, receiving grooves 102 are defined in vertical bars of the fixed shelf 100. When compared with the receiving grooves 35 and 36 of the first embodiment, the receiving grooves 102 have relatively long sizes to exactly receive the multiple slide bar 80. That is, the receiving grooves 102 are elongated in accordance with the length of the connecting portions 87 to securely and stably receive the slide bar 80.

The third embodiment has the same structure as the first embodiment, except for the described above. Thus, description for the same structure will be omitted.

Fourth Embodiment

Figure 10:
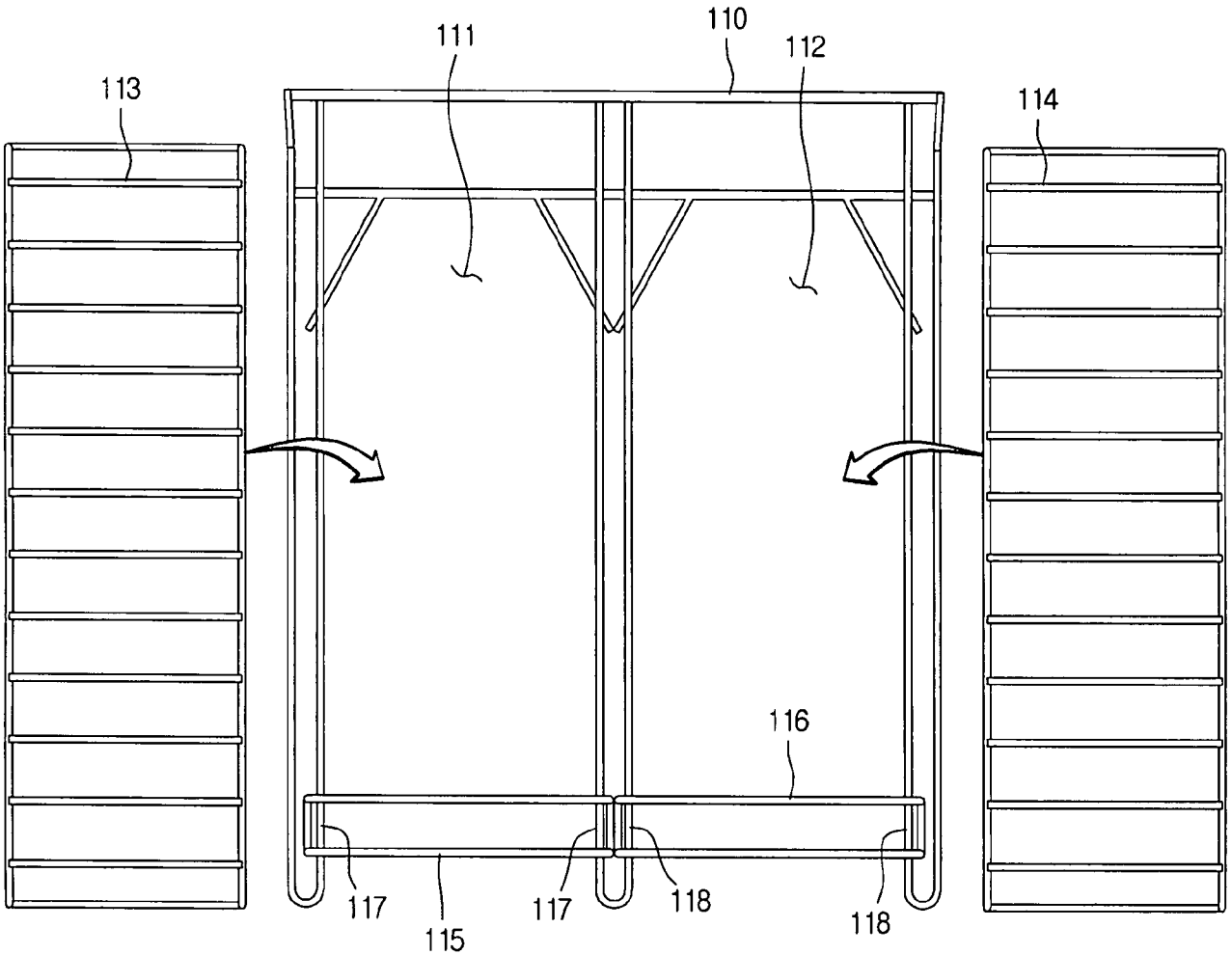
FIG. 10 is an exploded plan view of a rack structure according to a fourth structure of the present invention.

FIG. 10 is an exploded plan view of a rack structure according to a fourth structure of the present invention.

Referring to FIG. 10, first and second openings 111 and 112 are defined in left and right sides of a fixed shelf 110 to put food therethrough. A first movable shelf 113 and/or a second movable shelf 114 can be selectively placed to cover the first and second openings 111 and 112. Also, first and second slide bars 115 and 116 are provided to support front ends of the first and second movable shelves 113 and 114. Further, first and second receiving grooves 117 and 118 are defined in front ends of vertical bars of the fixed shelf 110 to securely receive and hold the first and second slide bars 115 and 116. The slide bars 115 and 116 may be symmetric with respect to the fixed shelf 110. Also, the first and second movable shelves 113 and 14 may be symmetric with respect to the fixed shelf 110.

According to this embodiment, the rack includes the first and second openings 111 and 112, and it also includes the first and second movable shelves 115 and 116 to cover the first and second openings 111 and 112. The first and second movable shelves 115 and 116 may be the same as the movable shelf 101 of the third embodiment. With this structure, the first and second movable shelves can be selectively removed to open the first opening 111 or the second opening 112, such that the rack can be use more effectively. Also, the first and second movable shelves can have higher durability and they can be easily installed and removed.

According to the rack structure of the present invention, various kind of food can be placed in the cavity by removing some part of the rack instead of entirely removing the rack from the cavity, thereby increasing user's convenience.

Also, the strength of the rack is increased such that more amount of food can be placed on the rack, thereby increasing user's reliability.

Further, the cavity can be changed in various forms depending on the embodiments, such that an oven employing the rack structure can be more conveniently used.

Further, the movable shelf can be easily installed and removed, and when the movable shelf is once installed it can be securely held in the installed position against external force, thereby increasing user's reliability.

In addition, the slide bar includes one or more bar portions to support the movable shelf, such that more amount of food can be placed on the movable shelf.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A rack structure of an oven defining a cavity therein to cook food, the rack structure comprising:

a fixed shelf disposed in the cavity and including an opening with a predetermined size and a first bar vertically arranged on each side of the opening;

a slide bar including an end slidable along the first bar; and a movable shelf including at least one portion supported by the slide bar and being capable of opening and closing the opening, wherein the movable shelf is removable from the slide bar, and the first bar includes a receiving groove to receive a portion of the slide bar.

2. The rack structure according to claim 1, wherein the opening is divided into at least two portions.

3. The rack structure according to claim 1, wherein the fixed shelf includes a plurality of first bars and second bars, and the movable shelf includes at least one portion supported by the second bars.

4. The rack structure according to claim 1, wherein the movable shelf includes a guide formed on at least one end.

5. The rack structure according to claim 1, wherein slide bar includes a bar portion with a predetermined length and a curved portion formed on at least one end with a predetermined curvature.

6. The rack structure according to claim 1, wherein the movable shelf includes at least one portion supported by the first bar.

7. A rack structure of an oven defining a cavity therein to cook food, the rack structure comprising:

a fixed shelf disposed in the cavity, the fixed shelf having a plurality of receiving grooves;

a movable shelf detachably installed on the fixed shelf; and a slide bar slidable along a portion of the fixed shelf for supporting the movable shelf, the slide bar being separate from the movable shelf, wherein the slide bar is configured to be caught in the receiving grooves when the slide bar moves along the fixed shelf.

8. The rack structure according to claim 7, wherein the slide bar includes a plurality of bar portions that are spaced apart from each other.

9. The rack structure according to claim 8, wherein the plurality of bar portions are parallel with each other.

10. The rack structure according to claim 7, wherein the slide bar forms a loop with a predetermined shape.

11. The rack structure according to claim 7, wherein the slide bar is abutted on a portion of the movable shelf to support the movable shelf.

12. The rack structure according to claim 7, wherein the fixed shelf includes a first bar and the slide bar is slidable along the first bar.

13. The rack structure according to claim 7, wherein the fixed shelf defines an opening with a predetermined size and the slide bar is slidable along the opening.

14. The rack structure according to claim 7, wherein the slide bar includes:

a plurality of bar portions;

curved portions formed on ends of the bar portions; and connecting portions for connecting the curved portions.

15. The rack structure according to claim 7, wherein the slide bar and the movable shelf are respectively provided in plurality, and both the slide bars and the movable shelves are symmetrically arranged with respect to the fixed shelf.

* * * * *